US007559591B1

(12) United States Patent
DeSanti

(10) Patent No.: US 7,559,591 B1
(45) Date of Patent: Jul. 14, 2009

(54) SNOW SHOVEL WITH FLEX CONTROL MECHANISM

(76) Inventor: Frederick Henry DeSanti, 41 Oakcrest Dr., Huntington Station, NY (US) 11746

( * ) Notice: Subject to any disclaimer, the term of this patent is extended or adjusted under 35 U.S.C. 154(b) by 480 days.

(21) Appl. No.: 11/084,915

(22) Filed: Mar. 21, 2005

Related U.S. Application Data

(60) Provisional application No. 60/555,226, filed on Mar. 22, 2004.

(51) Int. Cl.
*E01H 5/02* (2006.01)

(52) U.S. Cl. ..... 294/54.5; 294/49

(58) Field of Classification Search ..... 294/49, 294/54.5, 58, 59; 37/265, 285, 304, 434; D8/10

See application file for complete search history.

(56) References Cited

U.S. PATENT DOCUMENTS 2,896,993 A * 7/1959 Pollock ..... 294/54.5
3,021,625 A * 2/1962 Stasse ..... 37/434
4,224,751 A * 9/1980 Schoemann et al. ..... 294/59
4,305,376 A * 12/1981 Neugent ..... 294/49
4,372,064 A * 2/1983 Benenate et al. ..... 294/51
4,691,954 A 9/1987 Shaud
4,783,105 A 11/1988 Schultz
5,018,282 A * 5/1991 Hong ..... 37/434
5,472,252 A * 12/1995 Barone ..... 294/54.5
5,533,768 A 7/1996 Mitchell
5,704,672 A 1/1998 Sims
6,203,081 B1 3/2001 Kegan, Sr.
6,219,944 B1 * 4/2001 Byers ..... 37/265
6,254,154 B1 * 7/2001 Herzfeld et al. ..... 294/53.5

* cited by examiner

*Primary Examiner*—Paul T Chin
(74) *Attorney, Agent, or Firm*—Island Patent; F. Scott Tierno

(57) ABSTRACT

A snow shovel including a middle portion interposed between, and coupled to, each of a blade portion and a handle portion. Included with the middle portion is a flex control mechanism structured for controlling an amount of downward flexing possible by the blade portion with respect to the handle portion. While collecting a volume of snow the blade portion is maintained and biased in a first normal position. When lifting a volume of collected snow, the blade portion flexes downwardly, possibly assuming a pre-established second fully flexed position. When the collected and lifted snow is tossed, the energy stored in the flexible member by the downward flexing helps assist in tossing the snow. This abstract is provided to comply with rules requiring an abstract, and is submitted with the intention that it will not be used to interpret or limit the scope and meaning of the claims.

17 Claims, 9 Drawing Sheets

SNOW SHOVEL WITH FLEX CONTROL MECHANISM

CROSS REFERENCE TO RELATED APPLICATION

The subject matter contained herein is related to provisional patent application Ser. No. 60/555,226 filed on Mar. 22, 2004, which is hereby incorporated by reference.

TECHNICAL FIELD

The present invention relates most generally to passive or non-powered snow shovels. More particularly, the invention relates to an improved snow shovel with an elongated flexible member interposed between, and suitably fixed to, each of a handle portion and a head portion (such as a snow blade portion). The invention teaches the use of a flex control mechanism for limiting an amount and direction of the flexing motion that is possible between the handle portion and a head/blade portion. Accordingly, the present invention provides embodiments of a 'middle portion' structured for providing a controlled and limited flexing of a head portion with respect to a handle portion.

BACKGROUND

The removal of snow is an arduous and common task in many regions of the world that experience cold winter weather. In locations where snow falls often, say with depths of 1 to 6 inches for each snow fall, there is a constant need to be shoveling and pushing snow off of walk ways, driveways, etc. In addition, there are often situations wherein a collected volume of snow must be lifted and tossed a short distance, say 3 to 10 feet, for example.

The prior art provides a large number of varied types of manually operated snow shovels. Significant differences can be found essentially in the shape and structure of several important components. For example, the handle portions employed may range from simple linear wooded poles or rods, to more complicated curved structures incorporating hand grip means and constructed of light weight metals or advanced materials. Further, the design, shape, and capacities of blade portions, employed for collecting, pushing, and or lifting snow, may also vary considerably. For example, simple and well known embodiments of snow shovels may provide an essentially flattened (planar) blade portion, possibly with several curved perimeter portions. This first construction enables a user to push and collect a fairly large volume of the snow, and subsequently lift the snow for tossing purposes. Another commonly available blade portion is termed 'scoop' or 'plow' shaped. This latter blade arrangement, which can be used to lift lesser amounts of snow, is most often employed to push the snow aside (possible without any lifting activity). There also exists in the prior art a variety of more complicated snow shoveling devices. For example, there are handle constructions that are taught including structures to aid in 'shock absorption', which may be helpful when the ground contacting edge of a blade portion catches on something while being pushed by a user. Yet others are known in the art.

Importantly, the prior art is silent on teachings related to an improved 'middle portion' for coupling the handle to a blade portion for aiding in the tossing of snow. Desired arrangements and structures may include, for example, a flex enabling means for supporting a limited and controlled flexing, by way of a lever action. For example, the lever action may be established between the blade portion of a snow shovel and a user held handle portion, with a controlled flexing supported when a user lifts a volume of collected snow upon the blade portion.

A number of other additional characteristics, advantages, and or associated novel features of the present invention, will become clear from the description and figures provided herein. Attention is called to the fact, however, that the drawings are illustrative only. In particular, the exemplary embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, an improved snow shovel is structured for collecting and lifting a volume of snow, and subsequently, aiding the user in a tossing of the volume of snow aside. The present invention does not require any kind of internal power source, such as a battery, or any kind of external power source, such as provided by an electrical power cord. All energy applied to operating the snow shovel of the invention is user provided.

The snow shovel includes a blade portion having a first end and a second end. The first end of the blade portion is preferably structured with a ground contacting edge provided at a perimeter of the first end. The ground contacting edge may be included and structured for suitably contacting a ground surface for collecting a volume of snow upon an upper snow collecting surface of the blade portion.

Also included with the snow shovel of the present invention is a flexible member, preferably an elongated structure having a first end and a second end. The flexible member may most preferably be provided as a rod-like (round) elongated member or alternately a flattened elongated member (with a more rectangular cross section). The first end of the flexible member is suitably rigidly coupled, possibly in a detachable fashion, to a pre-selected perimeter location of the blade portion proximate to a second (upper) end thereof. Any suitable arrangement for fixing the first end of the flexible member to the second end of the blade portion, which may be termed a 'coupling', 'coupling means', and or a 'coupling mechanism', is to be considered within the scope of the invention. For example, a simple bolt and wing-nut arrangement might be employed. Alternately, skilled persons may utilize more complex structures including a 'quick release' pushbutton.

A typically elongated handle portion is also included having a first end and a second end. The first end of the handle portion is coupled to the second end of the flexible member, preferably in a substantially axial, linear, or in-line manner. A most preferred embodiment of the snow shovel in accordance with the present invention provides for the blade portion, the flexible member, and the handle portion to be coupled and structured such that when the snow shovel is being employed by a user for lifting a volume of collected snow, the flexible member will support a downward flexing, for a controlled flex distance, of the blade portion with respect to the handle portion. Accordingly, the invention further includes a flex control mechanism providing for the downward flexing to be controlled and over a pre-established flex distance, as the volume of snow is lifted by the user. As appreciated by skilled persons, there is an increase of the potential energy stored in the flexible member as the flexing downwardly is effected. As such, as the lifted snow is subsequently being tossed by the user, the added potential energy is available to assist in the tossing the volume of snow.

Importantly, the present invention teaches a 'middle portion', which may be considered to include the flexible member, along with the flex control mechanism, and possibly one or more mechanical couplings. The middle portion and the flex control mechanism will enable the flexing downwardly of the blade portion with respect to the handle portion, over the "controlled pre-established distance". Further, the most preferred embodiments of the flex control mechanism of the invention provide for an initial biasing and maintaining of the flexible member and the blade portion in a first normal position—wherein an initial pre-selected amount of potential energy is already stored in the flexible member by an initial loading (bending) of the flexible member. That is, structures of the flex control mechanism cause an initial biasing and loading, for example by providing for a slight bending the flexible member, while in this first normal (biased) position. Further, the middle portion and flex control mechanism are structured such that the pre-determined amount of biasing force is utilized for maintaining the first normal position, even while a user is collecting a volume of snow upon the blade portion.

Once a volume of snow is collected upon the blade portion, a user lifts the snow, thereby causing a flexing downwardly of the blade portion with respect to the handle portion, with the flexing limited to a controlled maximum flex distance, as established by the flex control mechanism. Once flexed downwardly, the blade portion is said to assume a second flexed position. Again, when in the second flexed position, the flexible member has an increased level of potential energy (relative to the first normal position). This increase of potential energy is now available to the user to assist in tossing the lifted snow aside—causing the blade portion to "pop" back into the first normal position.

Although many forms of flexible members and flex control mechanisms are possible, two exemplary embodiments will be fully described hereinafter—with others certainly providable by skilled persons based on these exemplary versions. Importantly, any suitably structured middle portion of the snow shovel, including the flexible member, the flex control mechanism, etc., will most preferably be structured such that side-to-side motion, and rotational or torsion flexing is prevented or minimized.

It is also important to note the middle portion taught herein, while described and depicted as being a portion of a snow shovel, may be readily employed as a middle portion with other tools and devices to enable a storing of potential energy to be available and utilized at the end of a motion, stroke, and or event. For example, the present invention may be included with a garden shovel, a pitchfork, a flattened rowing paddle, an oar, a broom head, a rake head, etc.

BRIEF DESCRIPTION OF THE DRAWINGS

In the drawings, like elements are assigned like reference numerals. The drawings are not necessarily to scale, with the emphasis instead placed upon the principles of the present invention and the interaction of required elements. Additionally, each of the embodiments depicted are but one of a number of possible arrangements utilizing the fundamental concepts of the present invention. The drawings are briefly described as follows.

PARTIAL LIST OF REFERENCE NUMERALS

Figure 1:
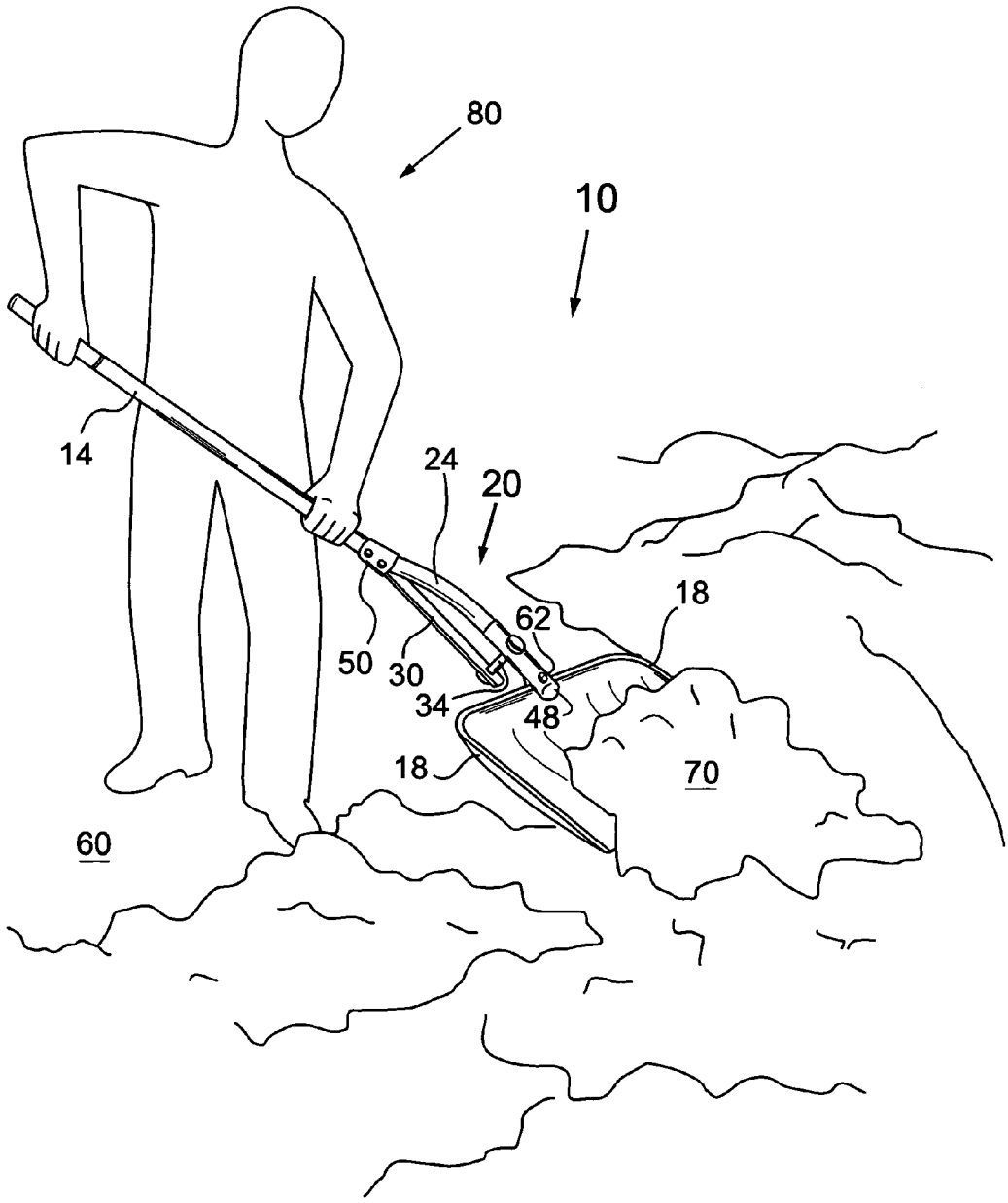
FIG. 1 is an elevated perspective view of an embodiment of a snow shovel structured with a middle portion of the invention, with the snow shovel being used to collect a volume of snow for subsequent tossing.

| | |
|---|---|
| 10, 10a | snow shovel |
| 14 | handle portion |
| 14a | first end of 14 |
| 14b | second end of 14 |
| 14-1 | modified handle portion |
| 15 | extended lower handle portion of 14-1 |
| 15a | first (lower) end of 15 |
| 18 | blade portion |
| 18a | lower or first end of 18 |
| 18b | upper or second end of 18 |
| 19 | ground contacting edge of 18a |
| 20 | middle portion |
| 24, 24-1 | flexible member |
| 24a | first end of 24 |
| 24b | second end of 24 |
| 30, 30-1 | rigid elongated member |
| 30a, 30-1a | first end of 30 |
| 30b | second end of 30 |
| 32 | thru-hole or slot |
| 34 | flex control post |
| 34a | first end cap of 34 |
| 34b | second end cap of 34 |
| 34b-1 | wing-nut |
| 34b-2 | cap-nut |
| 40 | flex control mechanism |
| 44 | flex control loop |
| 48 | (first) mechanical coupling |
| 50 | (second) mechanical coupling |
| 56 | locking mechanism |
| 60 | ground surface |
| 62 | threaded bolt |
| 66 | hole in 34 |
| 68 | flex locking pin |
| 70 | load or volume of snow |
| 80 | user |
| 118 | (generalized tool) head portion |
| 118b | second end of 118 |
| A | pre-established flex distance |

DETAILED DESCRIPTION OF EMBODIMENTS OF THE INVENTION

It is important to establish the definition of a number of descriptive terms and expressions that will be used throughout this disclosure. The terms 'blade' and 'blade portion' may be assumed to be any arrangement that enables snow to be collected from a ground surface, and subsequently lifted for tossing aside. As such, the cross section of a blade or blade portion may be appear in a number of shapes varying from substantially flattened to significantly curved. When considering the broadest application of a 'middle portion' of the present invention, the blade portion may be replaced by a wide variety of items including a garden-type shovel head, a pitchfork head, a flattened rowing paddle end, a broom head, a rake head, etc. The term 'handle portion', as employed in describing a user holdable portion of the snow shovel, may be provided by any combination of linear, curved, offset, bent, and or other required portions. As such, the handle portion may a simple linear stick or tube (as illustrated), or alternately provided as a complicated curved elongated member. In addition, the blade portion and handle portion may be constructed of any available and suitable material, possibly including wood, aluminum, titanium, fiberglass, resin, and or composite materials. The terms 'rigid' and 'flexible', as applied items such as the rigid elongated member and the flexible member, respectively, are to be defined as follows. The term 'rigid' may be assumed to mean that the rigid elongated member flexes for a minimal, pre-determined, or negligible amount. While the flexing of the flexible member, when in either the first normal position or in the second flexed position, is noticeable, with the bending (flexing) of the flexible member being significantly greater than that of the rigid portion and resulting in an increase in the potential energy stored in flexible member. For example, consider a flexing of the blade portion with respect to the handle portion flex that is in the range of 3 to 9 centimeters. An associated 'flexing' of an included rigid elongated member (or equivalent) would preferably be significantly less, say 0.5 centimeters, if that much. The terms 'flex', 'flexed' and or 'flexing' are also well defined by way of the discussions provided hereinafter. The terms 'coupled', 'coupled to', etc., are to be understood to mean that two items are either directly connected together, or alternately, connected to each other via one or more additional (possibly implied or inherent) structures or components. For example, when considering the coupling of the first end of a flexible member to the second end of a blade portion, these two items may be directly fixed to one another, or alternately, connected via one or more additional mechanical items/structures. Such structures are certainly available in the prior art, and well know to skilled persons. Further, such a coupling may be a fixed coupling (e.g., a pressed on coupling or a nut and a bolt), or provided in a detachable configuration (e.g., a push button release mechanism or simple a wing-nut and bolt arrangement. Other important terms and definitions will be provided, as they are needed, to properly define the present invention and its associated novel characteristics and features.

Referring now to the drawings, FIG. 1 provides a perspective view of an embodiment of a snow shovel 10 in accordance with the present invention. As depicted a user 80 is employing the snow shovel 10 for collecting a volume of snow 70. Once a volume of snow 70 is collected upon an upper surface of the blade portion 18, which may also be termed an upper snow collection surface, the user 80 may lift the volume of snow 70, and subsequently, toss the snow aside. As will be discussed in great detail hereinafter, the snow shovel 10 of the present invention provides a means for aiding a user in tossing a collected volume of snow 70. As further shown in FIG. 1, and as better seen in FIG. 2, the present embodiment further includes a 'middle portion' 20. The middle portion 20 is interposed between the blade portion 18 and the handle portion 14. Collectively, the blade/head portion, the middle portion 20, and the handle portion are coupled so as to be somewhat substantially linearly aligned (assuming the handle is not overly curved or bent). It is the specific function of the middle portion 20 to support a 'controlled flexing', for a pre-established amount of flex or flex motion, of the blade portion 18 of the snow shovel 10 with respect to the handle portion 14. It may be noted that the terms "flex motion", "controlled flexing", and "flex distance" may be considered substantially equivalents.

Figure 2:
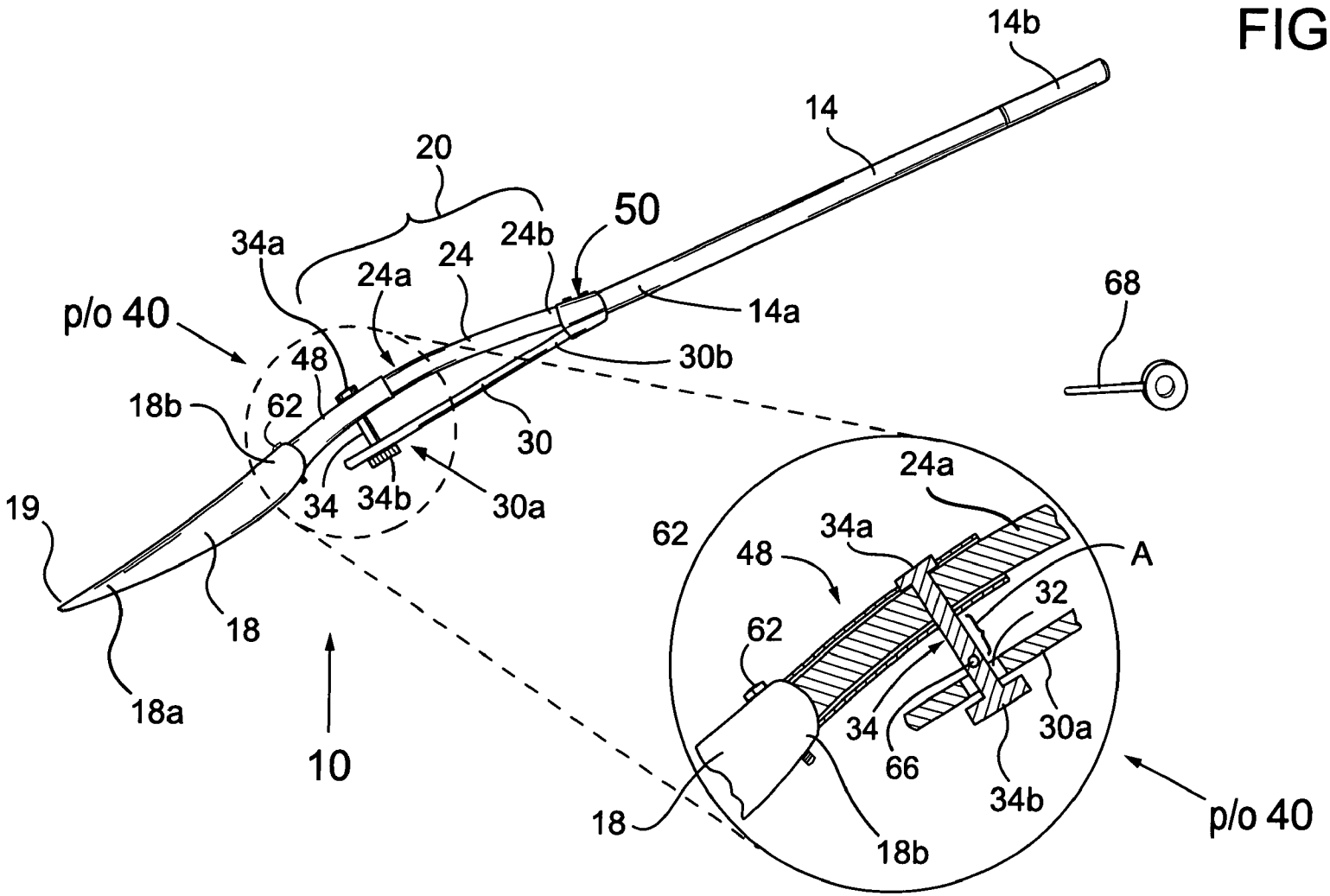
FIG. 2 shows a side view of a first preferred embodiment of a snow shovel of the invention, along with a detailed illustration of elements of the middle portion, including a flexible member, a flex control mechanism, associated couplings, etc.

Turning again to FIG. 1, and as also shown in FIG. 2, the blade portion 18, may be formed with a first end 18*a* and a second end 18*b*. The first end 18*a* is preferably configured with ground contacting edge 19, which is provided at a perimeter of the first end 18*a* of the blade portion 18. The ground contacting edge 19 and blade portion 18 are structured for contacting a ground surface 60 for collecting a volume of snow 70 to be tossed. The second end 18*b* of the blade portion 18 is coupled to a first end 24*a* of the flexible member 24. In the depiction of FIGS. 1 and 2, the coupling is effected by a first mechanical coupling 48. This coupling may be provided by a simple two piece clam shell arrangement employing one or more bolt-nut combinations. Most preferably the flexible member 24 is provided as an elongated resilient and flexible member with the first end 24*a* fixedly coupleable at a preselected perimeter location proximate to a second end 18*b* of the blade portion 18. It is to be understood that such a coupling of the second end 18*b* of the blade portion 18 may be directly connected to the first end 24*a* of the flexible member 24, as illustrated in FIG. 2, or may be coupled thereto using additional items and structures, for example, a mechanical coupling supporting quick detachability (not illustrated—but well known to skilled persons).

Further included with the snow shovel 10 is an elongated handle portion 14. The handle portion 14 illustrated is a simplified exemplary structure most preferably having a first end 14*a* and a second end 14*b* provided at opposite ends thereof. The first end 14*a* is preferably be coupled to the second end 24*b* of the flexible member 24, as illustrated. Therefore, the blade portion 18, flexible member 24, and the handle portion 14 are configured and substantially linearly coupled together such that when the snow shovel 10 is being employed by a user for collecting and subsequently lifting a volume of snow 70, the flexible member 24 is structured for supporting a flexing downwardly of the blade portion 18 with respect to the handle portion 14. Importantly, this downward flexing is limited to a pre-established (maximum) flex distance, such as the pre-established flex distance 'A' of FIG. 2. Accordingly, the downward flexing for a limited and known flex distance provides for a controlled increasing of the potential energy stored in the flexible member 24 as the volume of snow is lifted. This increased potential energy is then available to aid the user as the user tosses the snow aside. That is, the motion of tossing the lifted snow aside, causes the blade to 'pop' back into a biased first normal position, causing an aiding in the tossing of the collected and lifted snow.

Figure 3A:
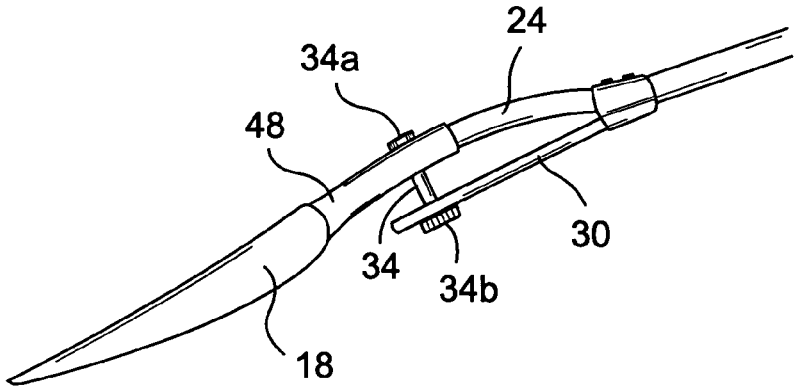
FIGS. 3A, 3B, and 3C collectively depict a sequence of related side view drawings of the snow shovel, including a middle portion of the invention, being used to collect a volume of snow (first normal position), lift the volume of snow (second flexed position), and subsequently toss the volume of snow (return to first normal position).

In order to control the amount of flexing permitted, and to further bias the flexible member 24 into a first normal position, as can be clearly seen in FIGS. 2 and 3A, a flex control mechanism 40 is included with preferred embodiments of the invention. Further, the most preferred embodiments of the flex control mechanism 40 of the invention provide for an initial biasing and maintaining of the flexible member and the blade portion in a first normal position—wherein an initial pre-selected amount of potential energy is already stored in the flexible member by an initial loading (bending) of the flexible member. This initial bending is clearly shown in FIGS. 1, 2, 3A, 3C, 5, and 6. As such, the most preferred structures of the flex control mechanism cause an initial biasing and loading, for example by providing for a slight initial bending the flexible member, while in this first normal position. Further, the middle portion and flex control mechanism are structured such that the pre-determined amount of biasing force is utilized for maintaining of the first normal position during snow pushing and collecting activities, and until a volume of snow collected upon the blade portion is lifted by the user.

As skilled persons will appreciate, the flex control mechanism 40 of the present invention may be embodied by a variety of structures. Importantly, the flex control mechanism 40 includes structures for limiting the range of flexing motion possible, when a flexing downwardly of the blade portion 18, with respect to the handle portion 14, occurs.

Figure 3B:
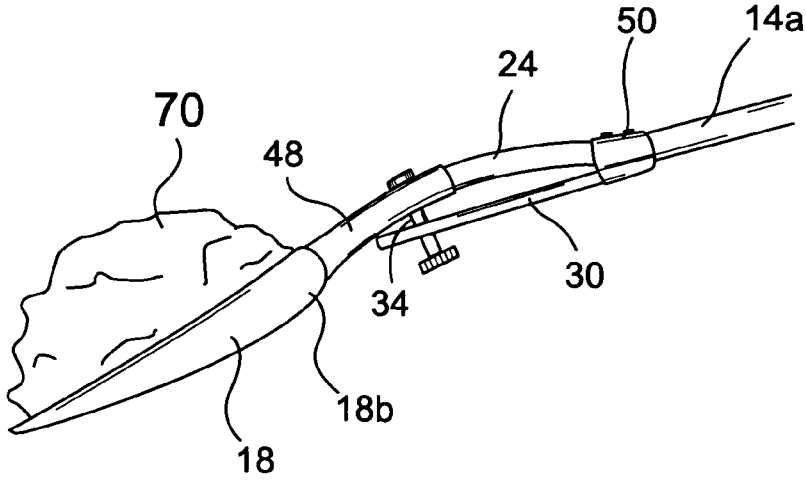

For example, as depicted in FIG. 3A, there is a biasing of the flexible member 24 into a first normal position, even as snow is being collected upon the upper snow collecting surface of the blade portion 18 (and not yet being lifted). Once the volume of snow 70 has been collected upon the blade portion 18, the flex control mechanism 40 is structured for enabling the blade portion 18 to flex downwardly and assume a second flexed position as the volume of snow 70 is lifted. FIG. 3B depicts an embodiment of the snow shovel 10 with the blade portion 18 flexed downwardly into the second flexed position. Note that the distance A, as best seen in the expanded view of FIG. 2, has been reduced in FIG. 3B, due to the downward flexing of the blade portion 18 with respect to the handle portion 14.

Figure 3C:
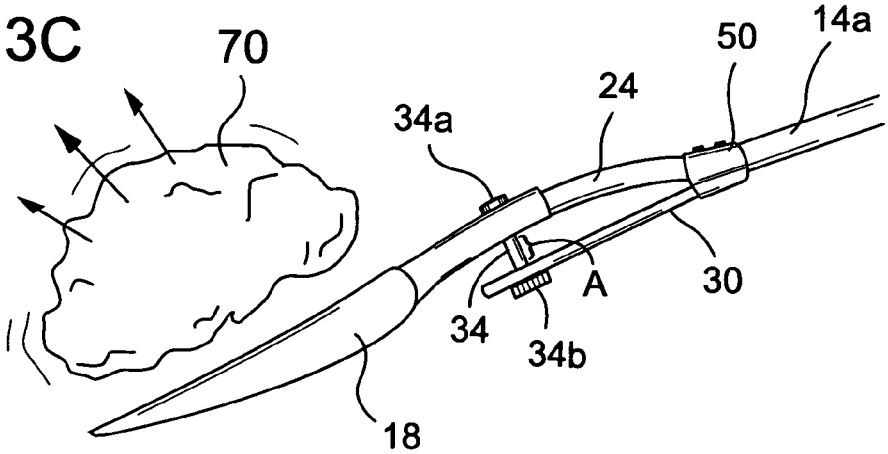
Figure 6:
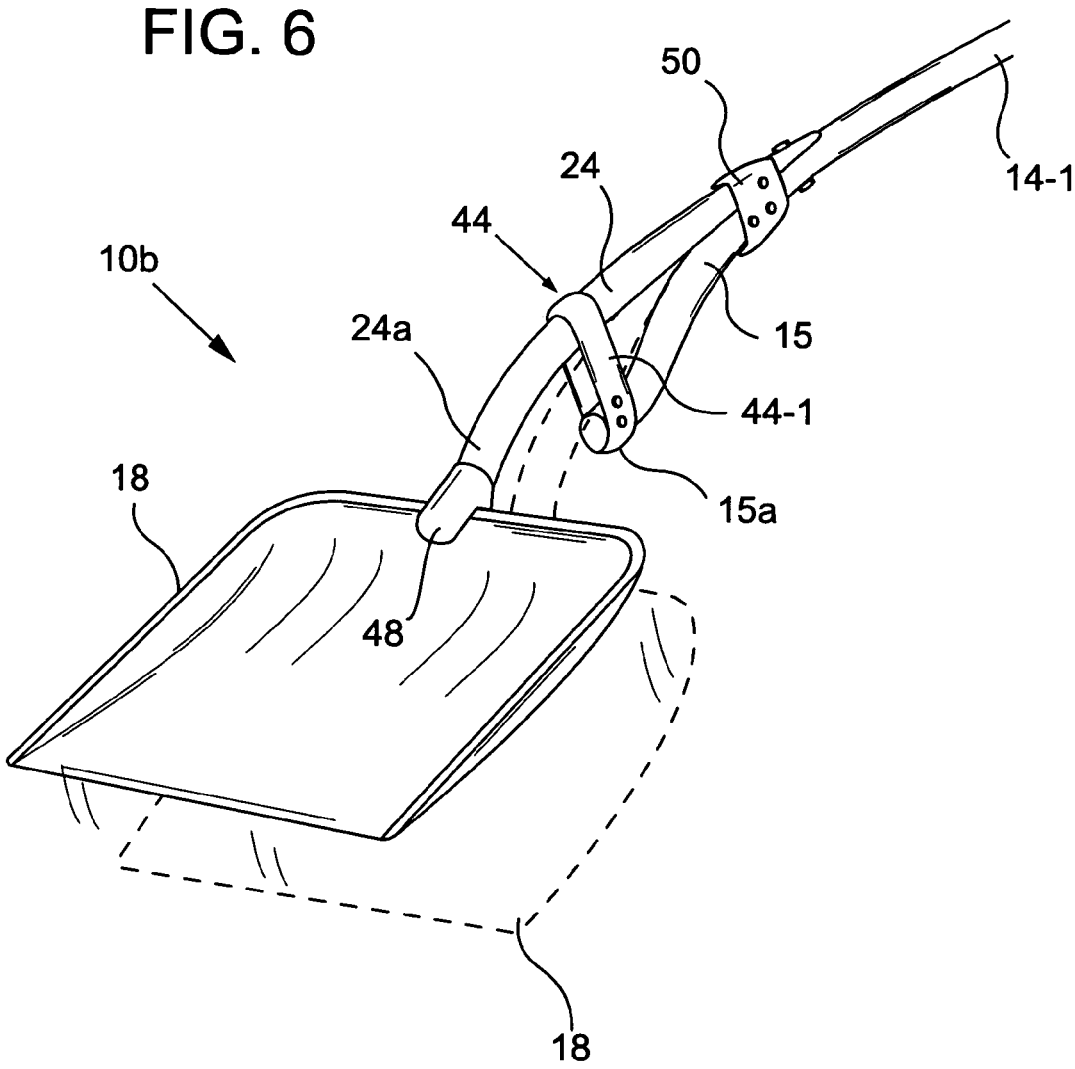
FIG. 6 provides a depiction of an embodiment of the invention, consistent with the embodiment of FIG. 5, wherein the upper handle portion and the rigid elongated member are each shown formed of a suitably shaped extended handle portion.

As understood by skilled persons, the flexing downwardly of the blade portion 18 causes an increasing of the potential energy stored in the flexible member 24 and available to the user for aiding in a subsequent tossing of the collected volume of snow 70. FIG. 3C depicts the blade portion 18 returned back to the first normal position, after the stored potential energy of the flexible member 24 has been applied to aiding in a tossing of collected and lifted volume of snow. FIG. 6 illustrates an example of a perspective view of an embodiment of a snow shovel 10 in accordance with the invention, shown in the first normal position (solid lines) and further in the second flexed position (as indicated by the dotted lines).

Returning to FIG. 2, it can be seen that a most preferred embodiment of a flex control mechanism 40 may include a rigid elongated member 30 or an equivalent structure. The rigid elongated member of the flex control mechanism is provided with a first end 30*a* and a second end 30*b*. The second (upper) end 30*b*, as depicted in FIG. 2, is mechanically coupled to the first end 14*a* of the handle portion 14. As shown in FIG. 2, as well as other figures of this disclosure, a second mechanical coupling 50 may be included to provide for a fixed, or alternately a detachable, coupling of the handle portion 14 to at least one of the rigid elongated member 30 and the flexible member 24. As further shown in the expanded view of FIG. 2, the flex control mechanism 40 may be structured with the first end 30*a* of the rigid elongated member 30 coupled in a movable or slidable manner, wherein the coupling is effected to one of a proximate and suitably spaced structure, such as:

a) the second end 18*b* of the blade portion 18;

b) the first end 24*a* of the flexible member 24; and or c) the first mechanical coupling 48.

For example, as shown in FIG. 1 through FIG. 3C, and possibly best seen in the expanded view of FIG. 2, a flex control post 34 may be provided with a first end cap 34*a* and a second end cap 34*b* located at the ends thereof. As depicted, the flex control post 34 is preferably provided extending substantially orthogonally between the first end 30*a* of the rigid elongated member 30 and one of the first end 24*a* of the flexible member 24, the second end 18*b* of the blade portion 18, and or the coupling 48. For the construction depicted in FIG. 2, first end cap 30*a* is fixed in position, with the control post passing through a thru-hole (or a suitably sized slot) 32. The end cap 34*b* may be provided having a suitable diameter so as to not be to be able to pass through the thru-hole or slot. The inclusion of the thru-hole 32 enables the first end 30*a* of the rigid elongated member 30 to move closer (via the movable or slidable coupling) to the first end 24*a* of the flexible member 24 as a downward flexing occurs due to a sliding of the first end of the rigid elongated member sliding along the flex control post 34. The flexing is realized by the flexible member moving from the first normal (flex) position to the second flexed position (when a volume of snow is lifted).

Figure 4A:
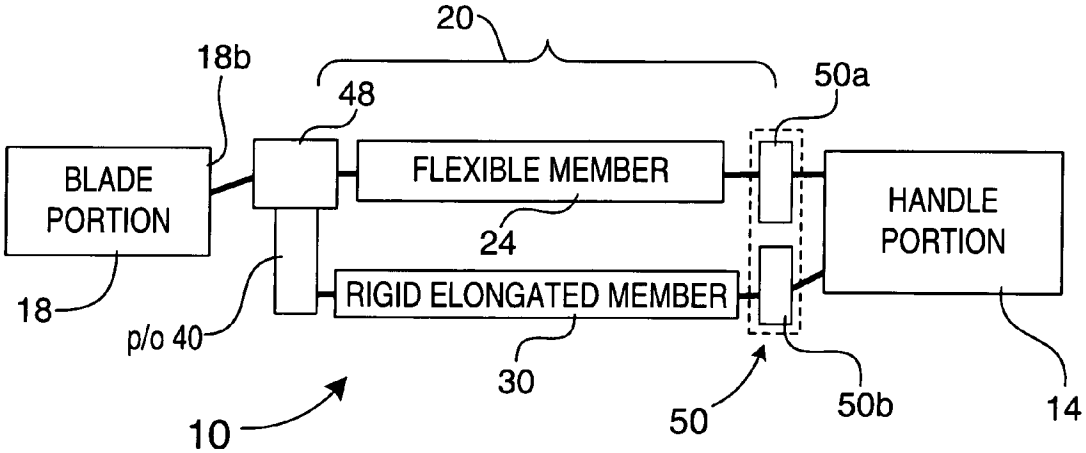
FIGS. 4A, 4B and 4C depict high level block diagrams of preferred operational embodiments of the invention.
Figure 4B:
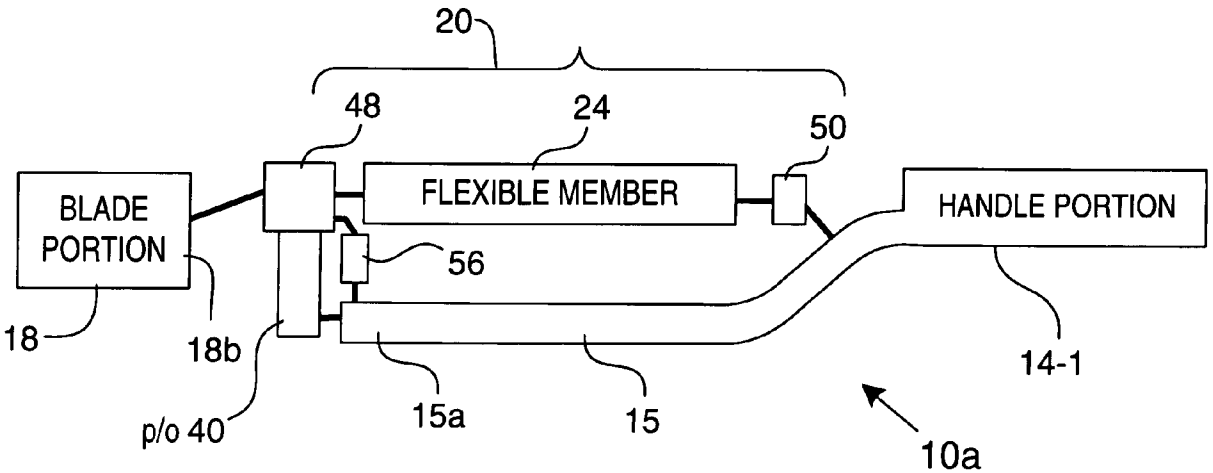
Figure 4C:
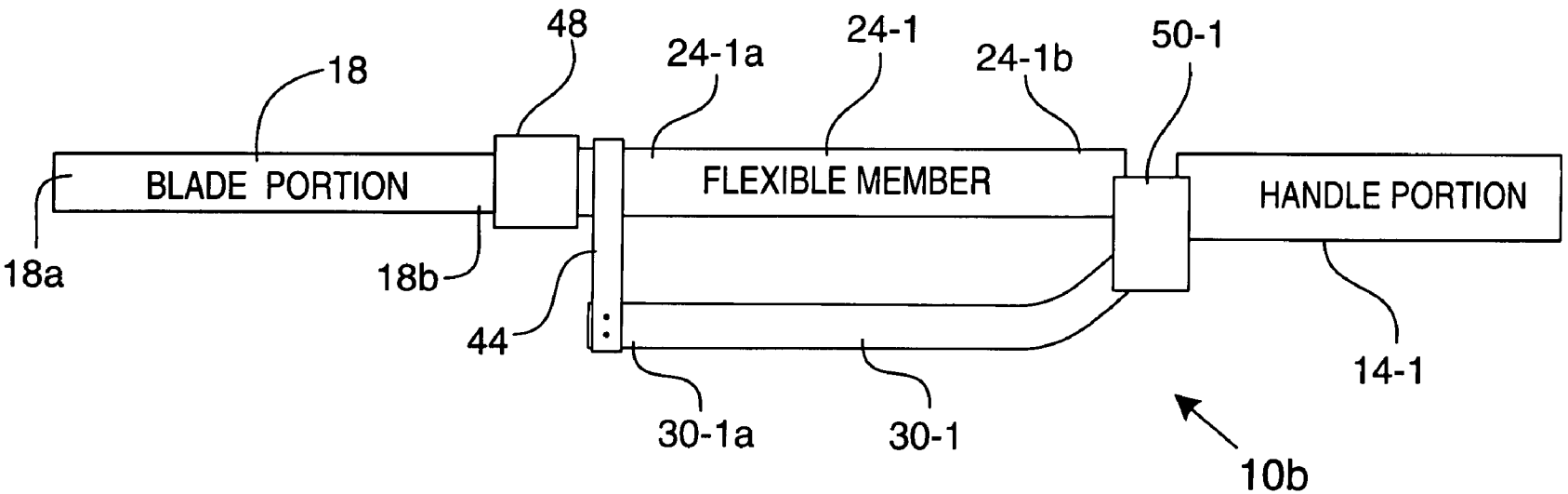

Turning to FIGS. 4A, 4B, and 4C there are illustrated therein high level block diagrams of preferred operational embodiments of the invention. FIG. 4A depicts a first embodiment, which is functionally equivalent to the embodiment of FIGS. 1 through 3C. As shown, the blade portion 18 is coupled to the flexible member 24 by way of a first mechanical coupling 48. For this embodiment, the flex control mechanism 40 establishes a movable or slidable coupling between the first mechanical coupling 48 and the rigid elongated member 30. Recall, the middle portion 20 may be considered to include structures such as the flexible member 24, the rigid elongated member 30, and other components of the flex control mechanism 40. Importantly, the embodiment of FIG. 4A provides for a rigid elongated member 30 that may be coupled to the handle portion 14 via a portion 50*b* of the second coupling 50. As such, an additional portion 50*a* of second coupling 50 may also be provided. It should be noted that the coupling 50 may be a simple mechanical structure that rigidly couples the second ends of the flexible member 24 and the rigid elongated member 30 to the first end of the handle 14.

In contrast to FIG. 4A, the embodiment of FIG. 4B provides for the inclusion of a modified handle portion 14-1. The modified handle portion 14-1 that includes an extended lower handle portion 15, which functionally is equivalent to the rigid elongated member 30 of the hereinabove disclosed embodiments. As such, one possible modification to the embodiments of FIGS. 1 through 3C, calls the handle portion and the rigid elongated member to both be provided by a single rigid modified handle portion 14-1, as clearly shown in FIGS. 4B and 6.

Turning now to FIG. 4C, there is depicted therein yet another embodiment of the invention. As shown, a head portion is again exemplified by the blade portion 18, which is coupled to the first end 24-1*a* of the flexible member 24-1 by coupling 48. The second end 24-1*b* of the flexible member 24 is rigidly coupled to the second end of the rigid elongated member 30-1 and the first end of the handle by second coupling 50-1. The embodiment of FIG. 4C, which is consistent with the embodiment of FIG. 5, includes a somewhat oval shaped flex control loop 44, which as illustrated is fixed at a first loop end 44*a* to the first end 30-1*a* of the rigid elongated member 30-1. The flex control loop 44 also loops over (at a second loop end) and wraps around an upper surface of the first end 24-1*a* of the flexible member 24-1. This arrangement provides another example of a flex controlling structure, and is functionally equivalent to the flex control post 34 of FIGS. 2 and 7B (and related structures as illustrated therein). That is, the flex control loop aids in biasing the flexible member into the first normal position, with a pre-selected bias force applied thereto. Further, upon a collecting and lifting of a volume of snow, enables the controlled flexing of blade portion 18 and flexible member 24 into the second flexed position (as depicted by the dotted line representations of the blade portion 18 and flexible member 24/24-1 of FIGS. 5 and 6).

Accordingly, however the flex control mechanism is structured, required functions provided by suitable flex control mechanisms include:

a) biasing and maintaining the blade and first end 24*a* of the flexible member 24 in the first normal position, as depicted in FIGS. 1, 3A, and 3C;

b) enabling the blade portion 18 and first end 24*a* of the flexible member 24 to flex downwardly with respect to the handle portion 14 upon a collecting and lifting of a volume of snow, assuming the second flexed position; and c) establishing (and limiting) a range of flexing motion possible between blade portion 18 and the handle portion 14 when moving between the first normal (flex) position and the second flexed position, or visa versa.

Figure 5:
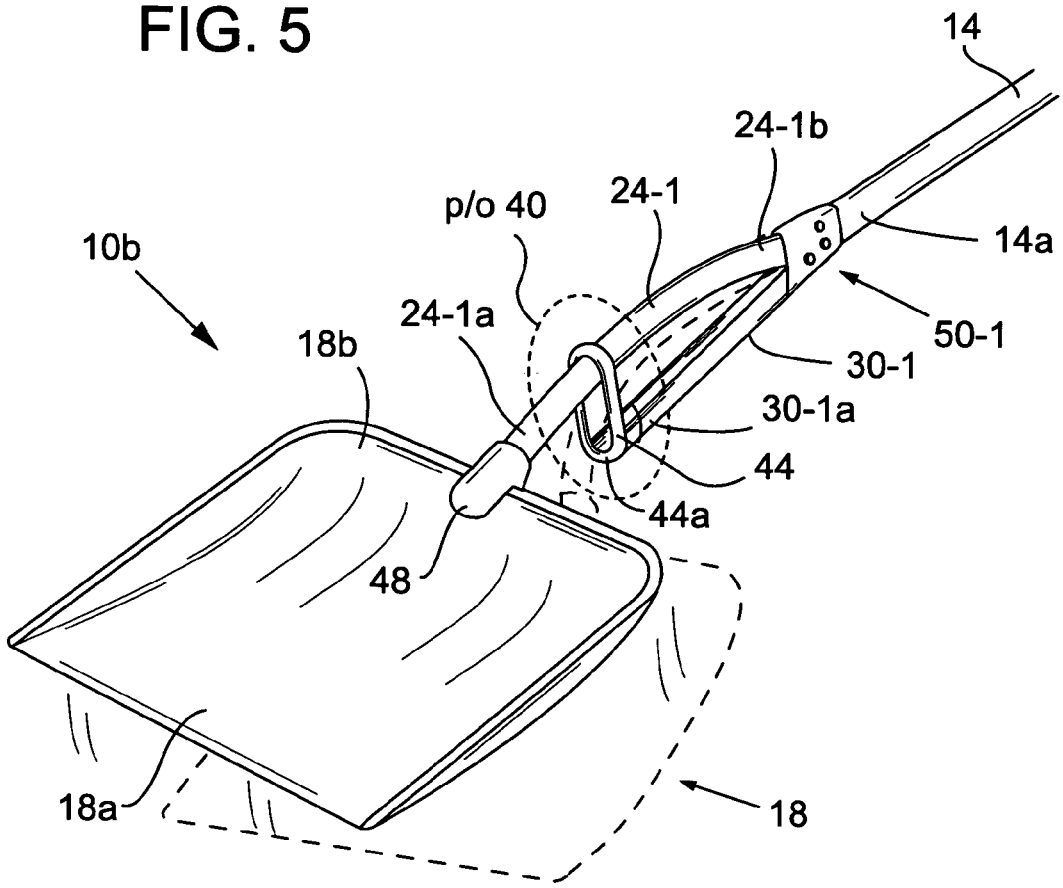
FIG. 5 provides an elevated perspective view of yet another embodiment of the invention.

It should be noted that snow shovels and other tools in accordance with the present invention may include a flex control loop that is actually a loop or oblong ring having the first loop end and the second loop end, as shown in FIG. 5, or alternately formed of a curved elongated strip portion shaped in a narrow upside-down 'U', such as depicted in FIG. 4C. Further, as depicted in FIG. 6, each end of the elongated strip portion 44-1 may be fixed proximate to the first end 15*a* of an extended lower handle portion 15 (as shown), or alternately, proximate to the first end 24*a* of the flexible member 24. FIG. 4C provides a high level depiction of a flex control loop 44 provided by a curved elongated strip portion shaped in a narrow upside-down 'U', with the ends of the strip portion fixed to the first end 30-1*a* of the rigid elongated member 30-1.

Regardless of the exact structure employed to embody the flex control mechanism 40, it may be desirable to include a locking mechanism 56 (as shown in FIG. 4B). The locking mechanism 56 is included to enable the user to selectively lock or unlock the flexing feature of the snow shovel. As such, when the locking mechanism 56 is locked, the flexing of the handle portion with respect to the blade portion is substantially or completely eliminated. Alternately, the user may unlock the locking mechanism 56, enabling the above discussed flexing motion of the handle with respect to the blade portion to occur.

A first simple embodiment of the locking mechanism, as depicted in FIG. 2, may be provided by a hole 32 provided in the flex control post 34 located proximate to the second cap end 34*b*. As shown in FIG. 2, the hole 66 would be located such that when a flex locking pin 68 is inserted into hole 66, the flexing motion of the flexible member 24 is substantially prevented. The flex locking pin may be tied to the shovel by employing a tether.

Figure 7B:
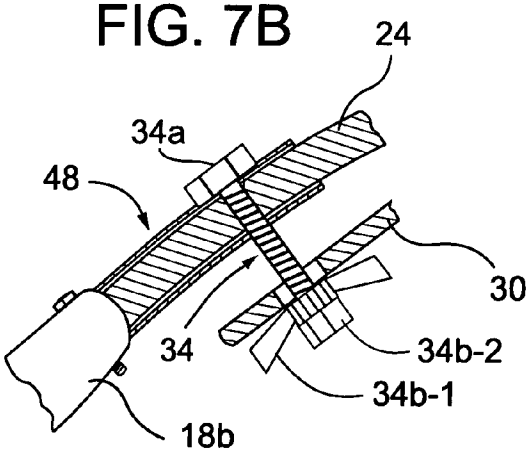
FIGS. 7B and 7C depict an embodiment of a locking mechanism in accordance with the invention.
Figure 7C:
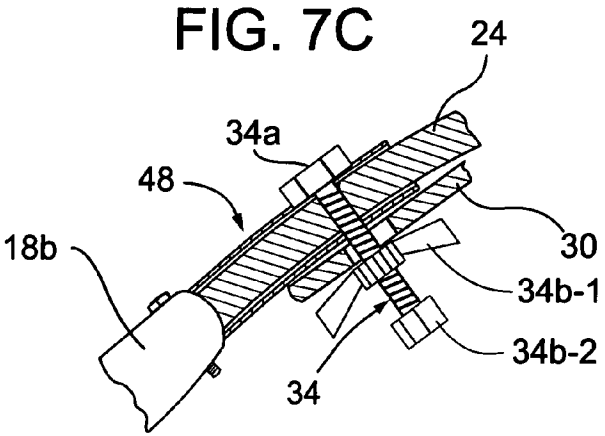

Another possible form of a locking mechanism 56 may be provided by the structures depicted in FIGS. 7B and 7C. The flex control post 34 therein is provided as a threaded bolt. In the embodiment shown, two threaded nuts are included: a cap-nut 34*b*-2 and a wing-nut 34*b*-1. The wing-nut 34*b*-1 is placed on the threaded bolt first, and then the end of the bolt is 'capped' with the cap-nut. A most preferred cap-nut 34*b*-2 may be provided by a steel-nylon self locking nut. With the wing-nut 34*b*-1 in a first position, as shown in FIG. 7B, flexing can occur. Alternately, if the wing-nut 34*b*-1 is positioned in a second (clamping) position, as depicted in FIG. 7C, flexing is prevented. The wing-nut 34*b*-1 is contemplated to be user operated without the need of hand tools.

As appreciated by skilled persons, the present invention may be constructed using a variety of materials. For example, common materials employable for forming the handle portion 14 or modified handle portion 14-1 include at least one of wood, aluminum, titanium, fiberglass, any of a plurality of available composite materials. Contemplated and suitable flex control loops, and equivalents thereto, may be structured of materials such as one or more of steel, aluminum, fiberglass, plastic, and a variety of composite materials.

Importantly, the flexible member 24 may also be provided in a variety of forms and structures. A preferred embodiment of the flexible member 24 is providable by employing an elongated fiberglass rod or flattened rod—as clearly supported by the included figures. An alternate material may be provided by a suitable hard wood, such as hickory, ash, or elm. A most preferred embodiment would be structured with a first elongated member having a length of 10 to 20 centimeters, and a diameter of 1 to 4 centimeters. The actual length and diameter of a suitable first elongated member may best be determined based on the actual material(s) of construction. It may be noted that a most preferred embodiment of the flexible member 24 may be provided as a rod that does not have a round cross section, and may possibly be best formed by a plurality of jointed or laminated layers.

Although a wooden or fiberglass rod may provide for possibly most preferred embodiments of a flexible member 24, other differing structures are certainly employable. For example, when considering the embodiments of FIGS. 4A and 4B, which may be considered broad depictions of the present invention, the flexible member 24 therein may be provided by a stiff coil spring (not illustrated) that is interposed axially between and fixedly coupled to each of the second end 18*b* of the blade portion 18 and the first end 14*a* of the handle portion 14. Further, such a coil, spring, or other possible flexible members may be constructed of composite materials, and could include a core material for stiffness and strength considerations.

Figure 7A:
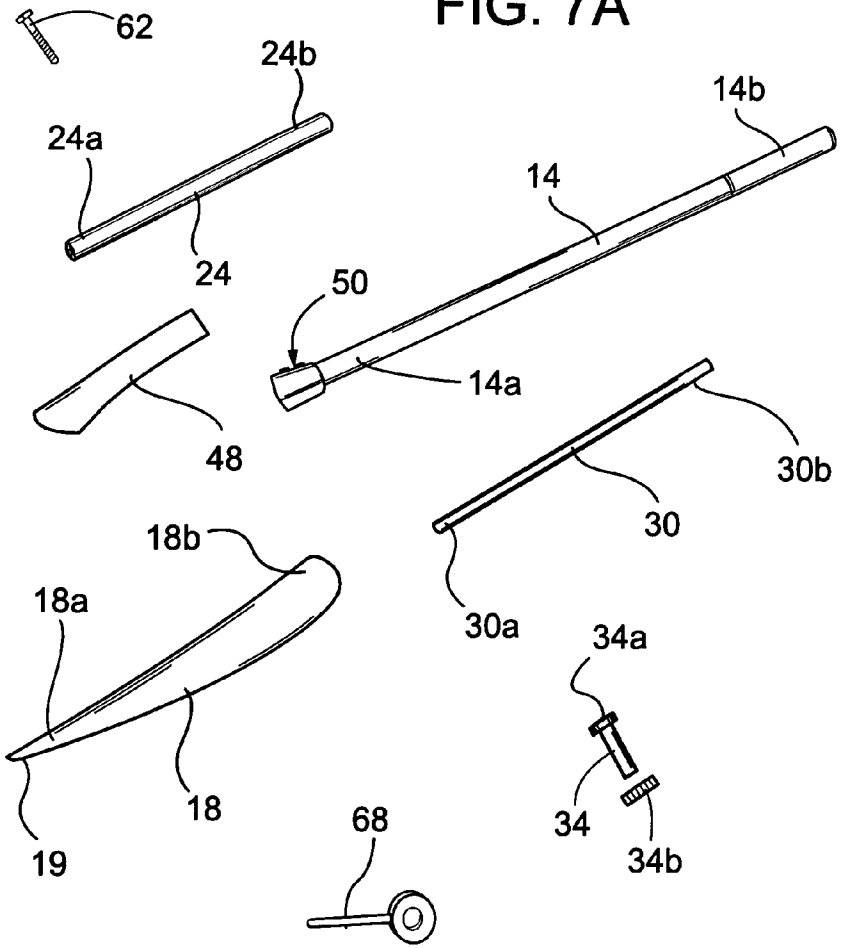
FIG. 7A provides a simplified disassembled view an embodiment of the invention, depicting a plurality of separated constituent components possibly in a kit form.

Turning to FIG. 7A, there is depicted there in a disassembled embodiment of the present invention. This possible level of disassembly may be a starting point for a kit version of the present invention. It is to be understood, that components such as threaded bolt 62 having a first head end and a second threaded end (also shown in FIGS. 1, 7A, 7B, and 7C) may be included to, for example, enable a user to detach the blade portion 18 (or any included head portion) from the middle portion 20, and thereby the handle portion 14 as well. If the threaded bolt 62 is provided as a wing-head bolt (not shown), it may be possible for the blade portion 18 to be detached without the need for additional hand tools. The detachability of items such as the blade portion 18, the handle portion 14, etc., may be desirable for other reasons, such packaging and shipping considerations, or to simply enable a user to more conveniently transport an embodiment of the invention.

Figure 8:
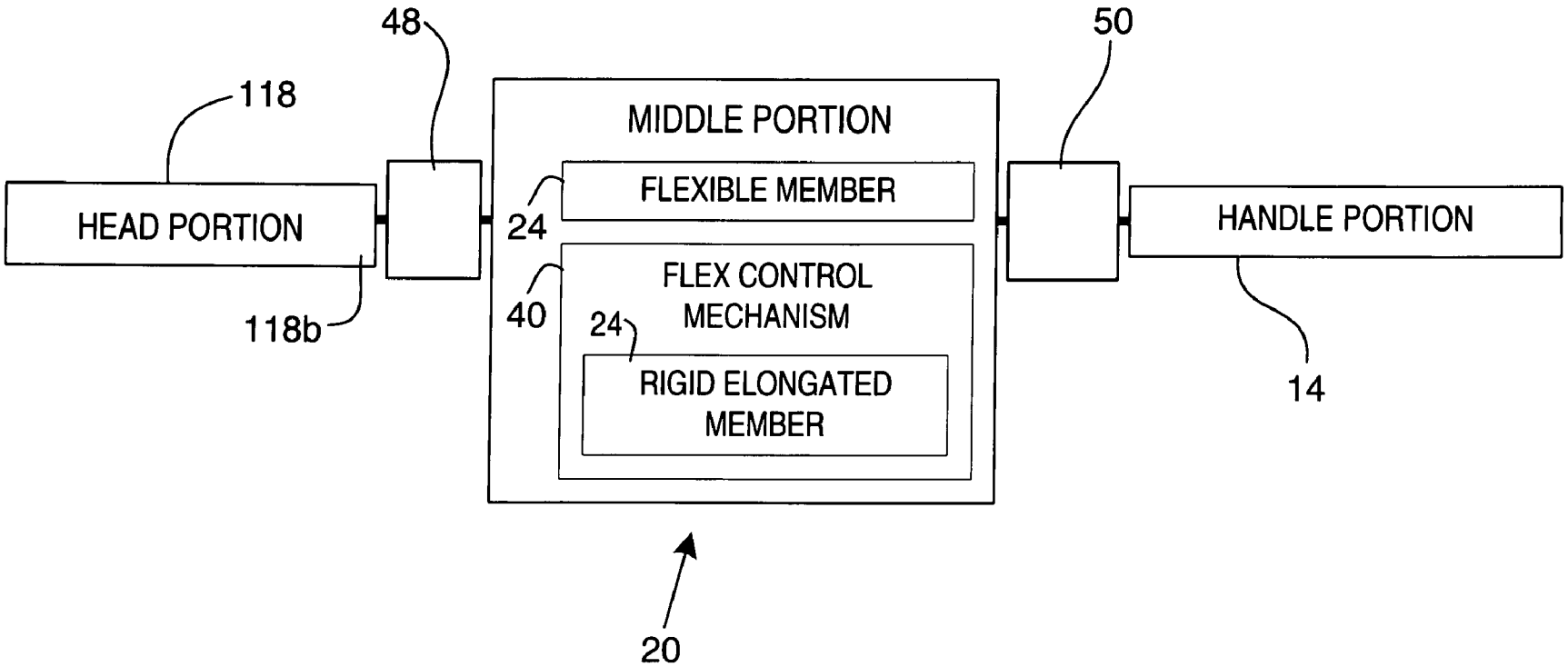
FIG. 8 provides a more generalized high level block diagram of embodiments of the invention incorporating the middle portion of the invention.

Referring now to FIG. 8, there is illustrated therein a more generalized high level block diagram of preferred embodiments of the invention. Included is a head portion 118, a middle portion 20, and a handle portion 14. As previously discussed, at least two couplings are include: coupling 48 and coupling 50. The first coupling 48 fixedly couples the head portion 118 (e.g., a snow blade) to the middle portion 20, while the second coupling 50 couples the middle portion to the handle portion 14. Is should be noted that the coupling 48 and coupling 50, or portions thereof, may or may not be considered parts of the middle portion, as determined by the respective embodiment and the associated structure thereof. As illustrated in FIG. 8, the middle portion 20 may include the flexible member 24, the flex control mechanism, and the rigid elongated member 30. The functions of these structures have been fully discussed hereinabove.

The embodiment of FIG. 8 may be configured to provide a number of differing embodiments based on the actual head portion employed, along with the actual handle shape and construction. Recall that a head portion may be provided as any of a variety of items including a spade shovel head, a pitchfork, a flattened rowing paddle end, a broom head, a rake head, etc.

Accordingly, while there have been described herein a plurality of the currently preferred embodiments of the present invention, along with contemplated methods of operation and use, those skilled in the art will recognize that other and further modifications may be made without departing from the invention. As such, the foregoing descriptions of the specific embodiments of the present invention have been presented for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A snow shovel, comprising:

a) a blade portion for contacting a ground surface for use in collecting a volume of snow, the blade portion arranged with a first end and a second end, with the first end structured having a ground contacting edge;

b) a handle portion structured having a first end and a second end;

c) an elongated flexible member fixedly coupleable to each of the blade portion at the second end and the handle portion at the first end, such that the handle portion, the elongated flexible member, and the blade portion are substantially linearly aligned, and arranged for the blade portion to flex downwardly, with respect to the handle portion, when a volume of collected snow is lifted upon an upper snow collecting surface of the blade portion for subsequent tossing;

d) a flex control mechanism included for, at minimum, limiting the range of flexing motion possible as the blade portion flexes downwardly with respect to the handle portion, the flex control mechanism including:

i) a rigid elongated member having a first end and a second end, with the second end of the rigid elongated member fixedly coupled to the first end of the handle portion and extending therefrom, such that the first end of the rigid elongated member is located proximate to and spaced from one of the second end of the blade portion and the first end of the flexible member; and ii) movable coupling means for movably coupling the first end of the rigid elongated member to a portion of the snow shovel at the second end of the blade portion, such that the blade portion is biased and maintained in a first normal position, with the blade assuming a second flexed position by flexing downwardly for a pre-established flex distance, with respect to the handle portion, when a volume of collected snow is lifted upon the upper snow collecting surface of the blade;

e) with the flexing downwardly and an assuming of the second position causing an increasing in potential energy stored in the flexible member and available for aiding in a subsequent tossing of the volume of snow.

2. The snow shovel in accordance with claim 1, wherein the movable coupling means is located proximate to each of the second end of the blade portion and the first end of the flexible member, and further includes a flex control post structured with a first end and a second end, with the first end of the flex control post fixed to one of:

a) a location proximate to where the flexible member is coupled to the second end of the blade portion; and b) the first end of the rigid elongated member.

3. The snow shovel in accordance with claim 2, wherein the flex control post extends substantially orthogonally between the first end of the rigid elongated member and the location proximate to where the flexible member is coupled to the second end of the blade portion, with the second end of the flex control post slidably coupled to the first end of the rigid elongated member such that the blade portion and flexible member can move between the first normal position and the second flexed position during snow shoveling activities.

4. The snow shovel in accordance with claim 1, wherein the movable coupling means includes a flex control loop as a portion of the flex control mechanism.

5. The snow shovel in accordance with claim 4, wherein the flex control loop is structured with:

a) a first loop end and a second loop end, with the first loop end of the flex control loop fixed to a location that is one of:

i) proximate to where the flexible member is coupled to the second end of the blade portion; and ii) proximate to the first end of the rigid elongated member;

b) with the flex control loop further configured to have passing therethrough one of:

i) the first end of the rigid elongated member, when the flex control loop is fixed to a location proximate to the second end of the blade portion; and ii) the first end of the flexible member, when the flex control loop is fixed to a location proximate to the first end of the rigid elongated member.

6. The snow shovel in accordance with claim 4, wherein the flex control loop is formed substantially of a curved elongated strip portion having a first end and a second end, with each end of the elongated strip portion fixed proximate to one of:

a) the first end of the rigid elongated member; and b) the first end of the flexible member proximate to where the flexible member is fixedly coupled to the second end of the blade portion.

7. The snow shovel in accordance with claim 1, wherein the flexible member is provided by at least one of:

a) an elongated fiberglass rod;

b) an elongated resilient member formed of a composite material.

8. The snow shovel in accordance with claim 7, structured such that at least one of the handle portion and the blade portion is removably coupled to the snow shovel for detachment therefrom, for storage or transporting purposes when not needed for collecting and tossing snow.

9. The snow shovel in accordance with claim 1, wherein the handle portion and rigid elongated member are formed of a single rigid modified handle portion, with the modified handle portion formed of at least one of:

a) wood;

b) aluminum;

c) titanium;

d) fiberglass; and e) a composite material.

10. A snow shovel structured for collecting and lifting a volume of snow, and subsequently, aiding in tossing the volume of snow, the snow shovel comprising:

a) a blade portion having a first end and a second end, the blade portion including a ground contacting edge provided at a perimeter of the first end of the blade portion, and structured for contacting a ground surface for collecting a volume of snow to be tossed;

b) an elongated flexible member having a first end and a second end, with the first end of the flexible member fixedly coupled to a pre-selected perimeter location proximate to a second end of the blade portion;

c) an elongated handle portion having a first end and a second end, with the first end of the handle portion coupled to the second end of the flexible member;

d) a flex control mechanism, including a rigid elongated member having a first end and a second end, with the second end of the rigid elongated member fixed proximate to the first end of the handle portion and extending therefrom such that the first end of the rigid elongated member is located proximate to and spaced from one of:
i) the second end of the blade portion, and
ii) the first end of the flexible member;

e) with the flex control mechanism structured for limiting the range of downward flexing of the blade portion with respect to the handle portion to the pre-established flex distance, wherein a collecting and lifting of a volume of snow upon an upper snow collecting surface of the blade portion causes the downward flexing of the blade portion and an increasing of the potential energy stored in the flexible member for aiding in a subsequent tossing of the collected volume of snow.

11. The snow shovel in accordance with claim 10, wherein the flex control mechanism is structured for:
a) initially biasing and maintaining the flexible member in a first normal position while the volume of snow is being collected but not being lifted; and
b) enabling the blade portion to flex downwardly with respect to the handle portion, assuming a second flexed position, when the volume of snow is being lifted to be subsequently tossed.

12. The snow shovel in accordance with claim 11, wherein flex control mechanism includes a coupling means for movably coupling the first end of the rigid elongated member proximate to one of:
a) the second end of the blade portion; and
b) the first end of the flexible member;
c) with the movable coupling means structured such that the blade portion is biased and maintained in the first normal position, and upon the collecting and lifting of a volume of snow thereupon, assumes the second flexed position by flexing downwardly with respect to the handle portion.

13. The snow shovel in accordance with claim 12, wherein the flexible member is provided by an elongated fiberglass rod having a first end coupled to the blade portion and a second end coupled to the handle portion.

14. The snow shovel in accordance with claim 10, wherein the handle portion and rigid elongated member are each provided by a single rigid modified handle portion formed of a single piece of elongated material.

15. The snow shovel in accordance with claim 10, further including a locking mechanism that may be employed by a user to prevent the flexing of the blade portion with respect to the handle portion.

16. The snow shovel in accordance with claim 15, wherein the locking mechanism includes:
a) a threaded bolt, providing a flex control post, having a first cap end and a second threaded end, the threaded bolt extending substantially orthogonally from and fixed to a location proximate to where the second end of the blade portion is fixed to the first end of the flexible member;
b) a cap-nut threaded and fixed onto the threaded bolt at the second threaded end;
c) wherein the threaded end passes through a hole provided at the first end of elongated rigid member and is capped by the cap-nut; and
d) a wing-nut, also threaded upon the threaded bolt and arranged to be placed in either one of:
i) a first position, wherein the controlled flexing of the blade portion with respect to the handle portion is enabled; and
ii) a second position, wherein the controlled flexing of the blade portion with respect to the handle portion is substantially prevented.

17. A middle portion including a flex control mechanism structured for being fixedly coupled between an elongated handle portion and a head portion, with the middle portion structured for enabling a controlled flexing of the head portion with respect to the handle portion, the middle portion comprising:
a) an elongated flexible member having a first end and a second end;
b) a rigid elongated member having a first end and a second end, with the first end of the rigid elongated member arranged proximate to and spaced from the first end of the flexible member;
c) a coupling for fixedly coupling the second end of the rigid elongated member, to the second end of the flexible member, and further available for rigidly coupling to a first end of the handle portion;
d) a second coupling available for fixedly coupling the first end of the flexible member to a selected head portion;
e) a flex control means for movably coupling the first end of the rigid elongated member to at least one of:
i) the second coupling;
ii) the second end of the head portion; and
iii) the first end of the flexible member;
f) with the flex control means included for:
i) biasing and maintaining the head portion in a first normal position with respect to the handle portion, with the biasing realized by providing for an initial bending of the flexible member when in the first normal position;
ii) enabling the head portion to flex downwardly with respect to the handle portion and assume a second flexed position, upon a collecting and lifting of a volume of snow; and
iii) establishing a range of flexing motion possible between the head portion and the handle portion when moving between the first normal position and the second flexed position, or visa versa; and
g) a locking mechanism that may be employed by a user to prevent the flexing of the blade portion with respect to the handle portion, the locking mechanism including:
i) a threaded bolt, providing a flex control post, having a first cap end and a second threaded end, the threaded bolt extending substantially orthogonally from and fixed to a location proximate to where the second end of the blade portion is fixed to the first end of the flexible member;
ii) a cap-nut threaded and fixed onto the threaded bolt at the threaded end;
iii) wherein the threaded end of the threaded bolt passes through a thru-hole provided at the first end of elongated rigid member and is capped by the cap-nut, establishing the first biased normal position; and
iv) a wing-nut, also threaded upon the threaded bolt and arranged to be placed in either one of a first position, wherein the controlled flexing of the blade portion with respect to the handle portion is enabled, and a second position, wherein the controlled flexing of the blade portion with respect to the handle portion is substantially prevented.

* * * * *